US007367263B2

(12) United States Patent
Jaffe

(10) Patent No.: US 7,367,263 B2
(45) Date of Patent: May 6, 2008

(54) FOUNTAIN

(76) Inventor: Martin J. Jaffe, 24 Lexington St., Dover, NH (US) 03820

( * ) Notice: Subject to any disclaimer, the term of this patent is extended or adjusted under 35 U.S.C. 154(b) by 116 days.

(21) Appl. No.: 11/344,281

(22) Filed: Jan. 31, 2006

(65) Prior Publication Data

US 2007/0176014 A1 Aug. 2, 2007

(51) Int. Cl.

| | |
|---|---|
| ***A62C 3/02*** | (2006.01) |
| ***A62C 15/04*** | (2006.01) |
| *E03B 9/20* | (2006.01) |
| *F21S 8/00* | (2006.01) |

(52) U.S. Cl. ..... 99/483; 99/452; 239/16; 239/17; 239/20; 222/413; 222/412; 222/411

(58) Field of Classification Search ..... 239/16, 239/17, 21–23; 219/429; 285/73
See application file for complete search history.

(56) References Cited

U.S. PATENT DOCUMENTS

| | | | | |
|---|---|---|---|---|
| 1,928,799 | A * | 10/1933 | Stevens | 47/39 |
| 3,713,583 | A * | 1/1973 | Gruber | 239/17 |
| 6,848,628 | B2 * | 2/2005 | Walker | 239/16 |
| 7,182,269 | B2 * | 2/2007 | Muir et al. | 239/16 |
| 2005/0092852 | A1 | 5/2005 | Muir et al. | 239/16 |
| 2005/0092853 | A1 | 5/2005 | Muir et al. | 239/16 |
| 2007/0007273 | A1 * | 1/2007 | Esnault | 219/429 |

* cited by examiner

*Primary Examiner*—Dinh Q. Nguyen
*Assistant Examiner*—James S Hogan
(74) *Attorney, Agent, or Firm*—Whiteford, Taylor & Preston LLP; Jeffrey C. Maynard

(57) ABSTRACT

A modular fountain assembly for controlling the temperature and flow of viscous fluid with a melting point between ambient and approximately 150 degrees Fahrenheit is disclosed. The modular assembly for controlling the heating and flow of fluid includes an enclosed controlling base and an upper recirculation module having a detachable lower basin, one or more modular tubular sections, a small high basin on top of the highest tubular section, an Archimedes screw of a set pitch dimension to facilitate the flow of the fluid from the lower reservoir to the small high reservoir atop the tubular section or sections, and a series of circular tiers atop each tubular section. The lower basin is attached to the controlling base using mechanical or electro mechanical support structures. The controlling base provides rotational force for the Archimedes screw at variable rotational speeds to drive the fluid upward within the modular tubes as well as a heating sub module. The lower basin has an upper bowl and a lower pool of fixed set depth with an opening to permit a drive shaft attach to the Archimedes screw. The circular base controls the temperature of the fluid using a temperature probe protruding from the lower base into the lower basin. The bottom modular tube attaches to one or more vertical support structures that extends from the controlling base thru the lower reservoir. The circular tiers are held stationary between modular tube sections or between the highest tubular section and the high basin.

23 Claims, 7 Drawing Sheets

FOUNTAIN

BACKGROUND OF THE INVENTION

1. Field of the Invention

The invention relates generally to flow of fluidic material that requires temperatures above ambient temperature within a closed loop to produce a waterfall of fluidic material that is recirculated. The recirculated fluid may be a food such as chocolate, caramel, or cheese or other food may be melted at temperatures above ambient and less than 150 degrees Fahrenheit. The invention may be used as a food dispensing fountain or a variable size artistic display.

2. Background of the Prior Art

Recirculating fountains containing various fluids have been manufactured for a multitude of decorative purposes. Within the past few years a number of recirculation fountains have been developed that have internal heaters to maintain temperatures above ambient. The purpose of the heaters is to permit materials with melting points above ambient to be used in the fountains. Edible mediums have been used in such fountains and also provide a decorative item for the user.

This type of fountain is the subject of this patent application and will be referred to as an edible medium fountain. Recirculation fountains are built with a reservoir or basin of fluid that is pumped to a higher level and then allowed to flow over decorative objects below the upper release point. In the case of an edible medium fountain, current designs have developed a basic format wherein the fluid within the fountain is pumped from a lower basin to an upper basin and overflows the upper basin onto a series of tiers of increasing diameter. When properly leveled the intended affect is to provide a continuous flow of the fluid evenly across the top basin and the subsequent tiers. This provides a visual effect of a solid treelike object.

Recirculation of the edible medium requires a pump be integral to the fountain. As a result of the replacement of water or other fluids having lower melting points with fluids that are less viscous, the higher melting point food items require the pump to be thoroughly cleaned between uses. To pump fluid within the fountain, current manufacturers use a removable Archimedes screw.

The parts of an edible medium fountain include a base with leveling mechanism, a drive mechanism, a heating device with control for the heating device, a lower basin to contain fluid, and other parts including a tube or barrel to contain a removable Archimedes screw, an upper basin, and tiers that are held in place on the exterior of the barrel.

Existing edible medium fountains are constructed such that fluid materials may be captured at various points such that it is not possible to fully clean and sanitize the fountain. The embodiment of the design of present invention is such that any surface that is in contact with the edible fluid can be removed and thoroughly cleaned.

SUMMARY OF THE INVENTION

A modular fountain assembly for controlling the temperature and flow of viscous edible fluid with a melting point between ambient and approximately 150 degrees Fahrenheit is disclosed. The modular assembly for controlling the heating and flow of fluid includes an enclosed controlling base and an upper recirculation module having a detachable lower basin, one or more modular tubular sections, a small high basin on top of the highest tubular section, an Archimedes screw of a set pitch dimension to facilitate the flow of fluid from the lower reservoir to the small high reservoir atop the tubular section or sections, and a series of circular tiers atop each tubular section. The lower basin is attached to the controlling base using mechanical or electro mechanical support structures. The controlling base provides rotational force for the Archimedes screw at variable rotational speeds to drive the fluid upward within the modular tubes as well as a heating sub module. The lower basin has an upper bowl and a lower pool of fixed set depth with an opening to permit a drive shaft attach to the Archimedes screw.

It is, therefore, an object of the present invention to provide an edible medium fountain that avoids the disadvantages of the prior art.

It is another object of the present invention to provide an edible medium fountain having modular construction. It is a related object of the present invention to enable an edible medium fountain that is easy to assemble and disassemble. It is a further related object of the present invention to enable an edible medium fountain that is easy to clean.

The various features of novelty that characterize the invention will be pointed out with particularity in the claims of this application.

BRIEF DESCRIPTION OF THE DRAWINGS

The above and other features, aspects, and advantages of the present invention are considered in more detail, in relation to the following description of embodiments thereof shown in the accompanying drawings, in which.

DETAILED DESCRIPTION OF THE INVENTION

The invention summarized above and defined by the enumerated claims may be better understood by referring to the following description, which should be read in conjunction with the accompanying drawings in which like reference numbers are used for like parts. This description of an embodiment, set out below to enable one to build and use an implementation of the invention, is not intended to limit the enumerated claims, but to serve as a particular example thereof. Those skilled in the art should appreciate that they may readily use the conception and specific embodiments disclosed as a basis for modifying or designing other methods and systems for carrying out the same purposes of the present invention. Those skilled in the art should also realize that such equivalent assemblies do not depart from the spirit and scope of the invention in its broadest form.

Figure 1:
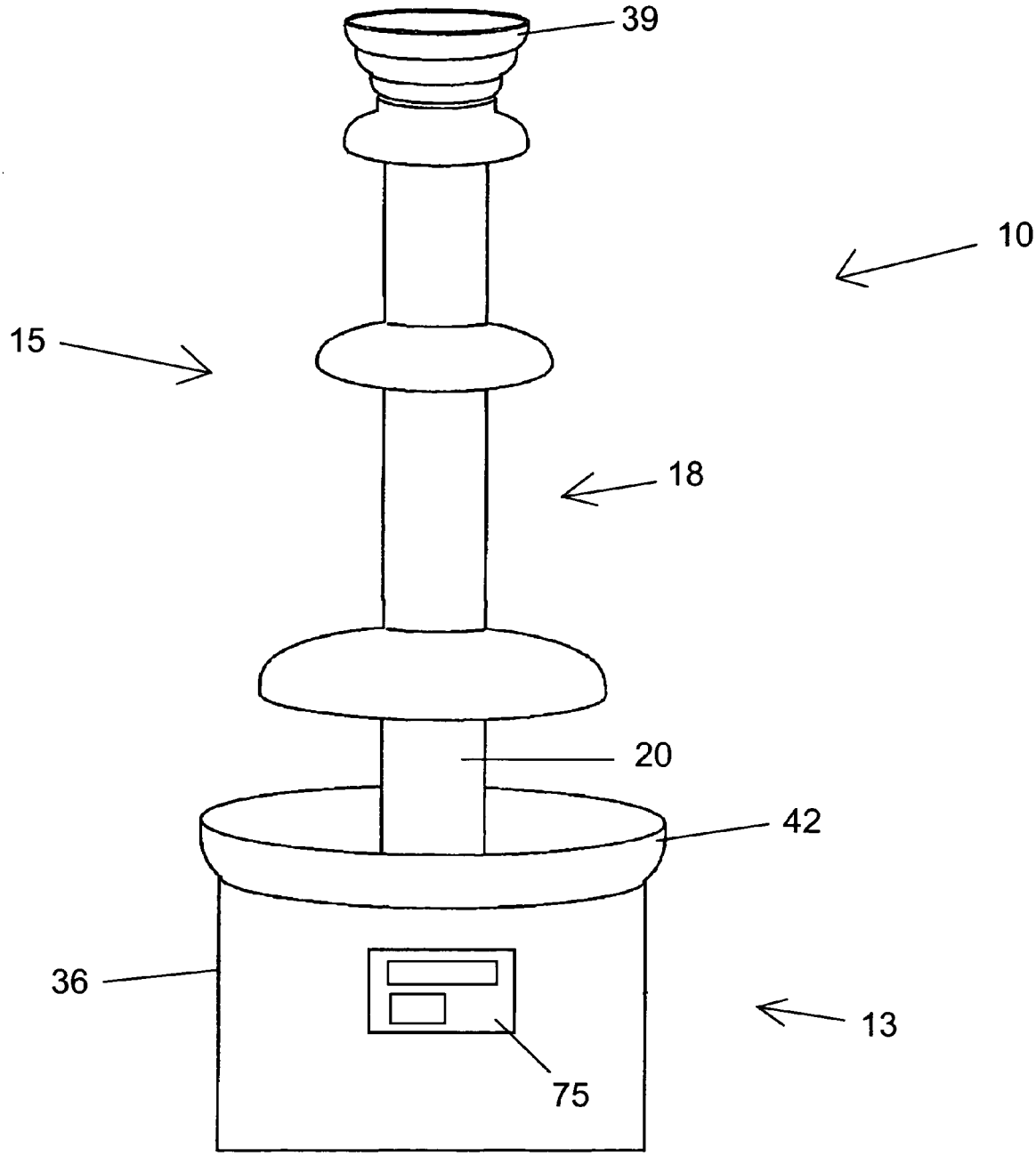
FIG. 1 is a side view of a fountain of the present invention.

Referring to the drawings, FIG. 1 shows a fountain, generally indicated as 10, according to the present invention. The fountain 10 comprises a lower heating and control section 13 and an upper barrel and tier section 15. According to the present invention, fountain 10 is modular in construction to enable ease of assembly in a variety of sizes.

Figure 2:
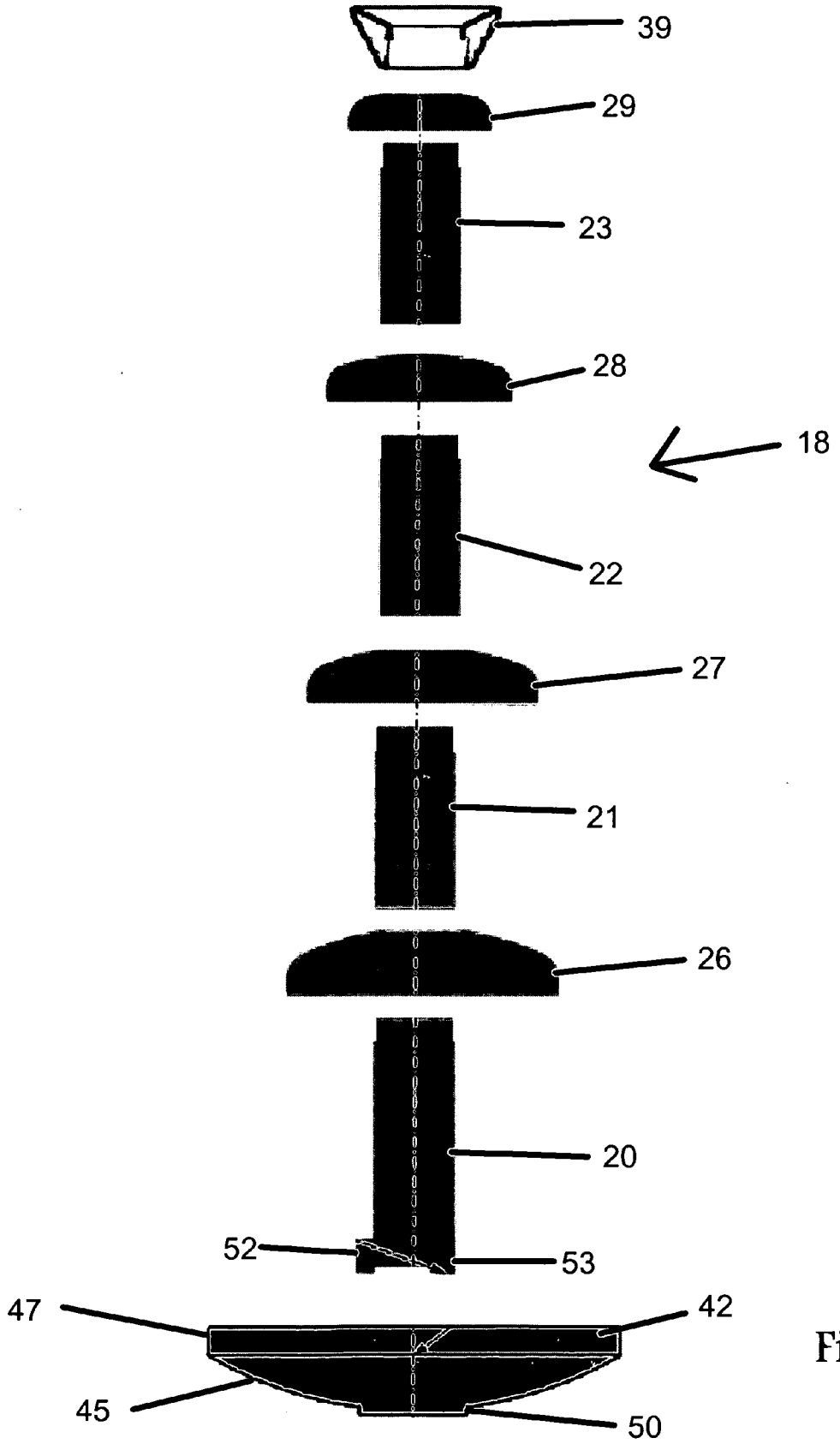
FIG. 2 is an exploded partial cross-sectional side view of a top module of the fountain of the present invention.
Figure 3:
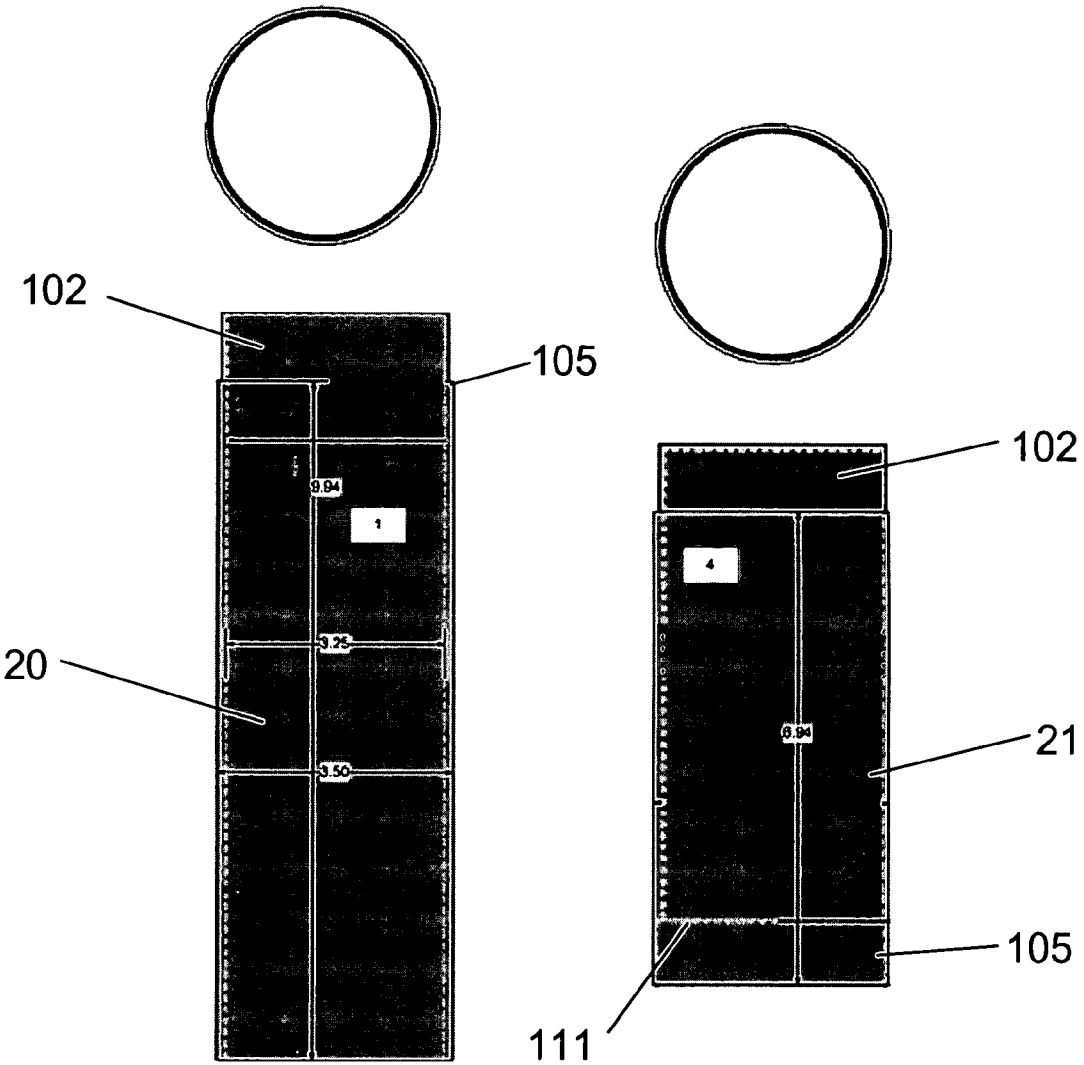
FIG. 3 is a side view of barrel sections of the fountain of the present invention.
Figure 4:
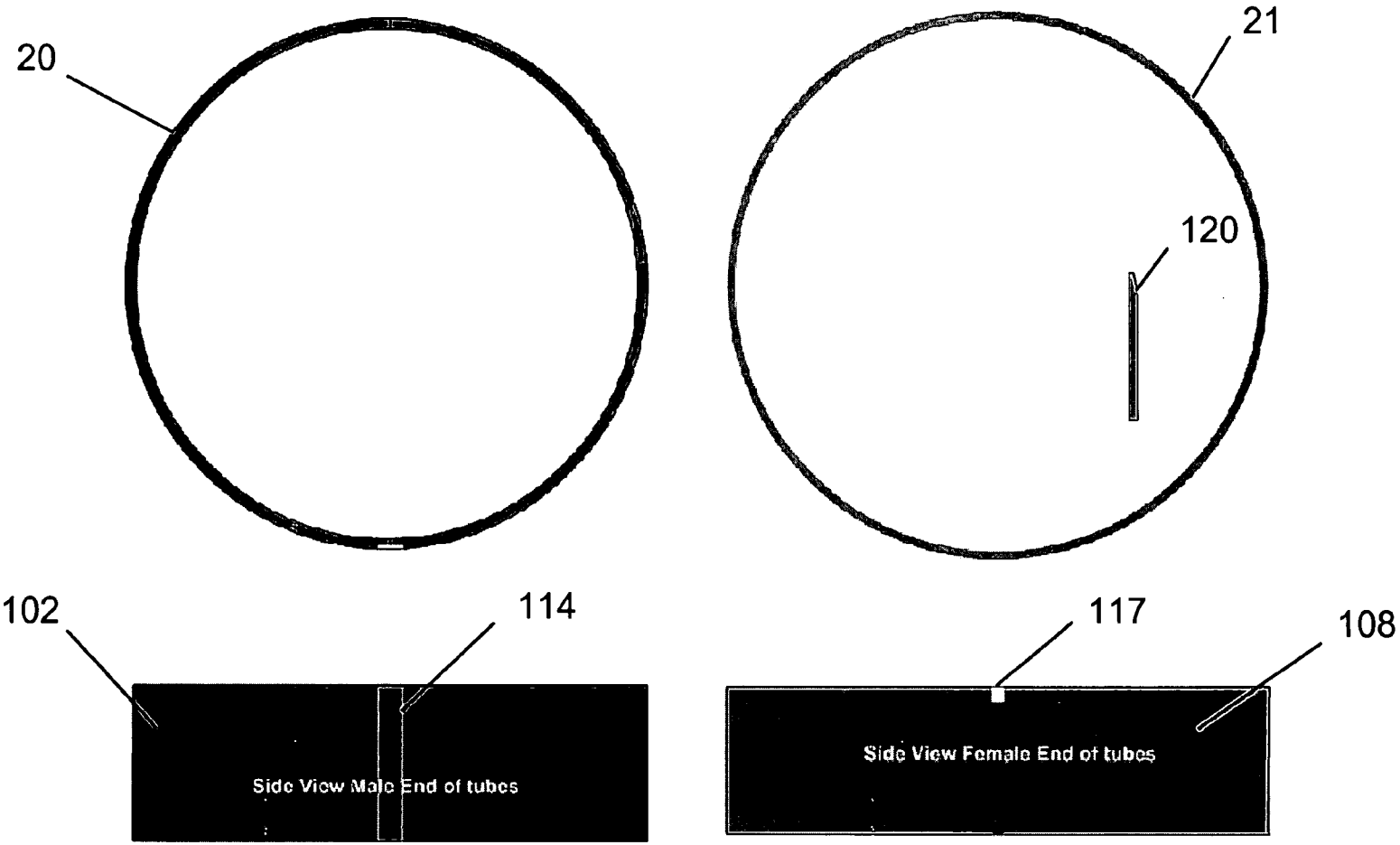
FIG. 4 is a close-up view of a top portion of a barrel section of the fountain of the present invention.

FIG. 2 shows an exploded view of the modular upper section 15. A centralized, hollow barrel 18 is designed for the fountain to be modular so that the barrel 18 used in any one instance may be set to various lengths. Modular sections 20, 21, 22, 23 of the barrel are attached to each other using interlocking shaped circumferences that prevent rotational movement of individual barrel sections 20, 21, 22, 23, as shown in FIGS. 3 and 4. The interlocking shape also provides sufficient space to secure one or more tiers 26, 27, 28, 29 in place perpendicular to the barrel 18. In some embodiments, only some of sections 20, 21, 22, 23 will be used to enable a fountain of various sizes. The number of tiers 26, 27, 28, 29 attached to the edible medium fountain should be equal to the number of barrel sections used in any one instance.

Referring to FIG. 3, lower barrel section 20 has a male fitting portion 102 on only one end. The male fitting portion is approximately one-inch deep and has an external diameter that is slightly smaller than the remaining portion of the barrel section 20, leaving a narrow ledge 105. Middle barrel section 21 has a male fitting portion 102 on one end and a female fitting portion 108 on the remaining end. The female fitting portion 108 has sufficient depth to functionally secure upper barrel sections and has an internal diameter that is approximately equal to the external diameter of the male fitting portion 102, leaving a shelf 111. In use, middle barrel section 21 is placed over bottom barrel section 20, such that the male fitting portion 102 operationally engages the female fitting portion 108 and the shelf 111 engages ledge 105.

To ensure proper alignment of barrel sections 20, 21, 22, 23, an alignment notch 117 is provided in one side of the female fitting portion 108, as shown in FIG. 4. The female alignment notch 117 is designed to facilitate engagement of the female barrel end with a depression 114 provided in one side of the male fitting section 102. Further, to enable ease of assembly, the inside edge 120 of the female fitting section may be slightly beveled.

Referring again to FIG. 2, the uppermost section of the barrel 18 supports an upper basin 39. The fluidic material used in the fountain 10 is pumped from the lower basin 42 to the upper basin 39 while contained fully inside the barrel 18. The fluidic material is allowed to overflow the upper basin 39 and cascade down over the tiers 26, 27, 28, 29 into the lower basin 42. The upper basin serves to equalize the flow of fluidic material so it may be evenly distributed over the tiers 26, 27, 28, 29 secured in place over the modular barrel sections 20, 21, 22, 23 and into the lower basin 42.

The lower basin 42 comprises a concave bottom 45 and a peripheral wall 47 creating a shallow, hollow dish having a hub 50. The design is unique to this edible medium fountain in that the lower basin 42 is shaped with the hub 50 in the center of the basin. The hub 50 is lower than the concave bottom 45 of the basin 42 in which the fluid fall from the tiers 26, 27, 28, 29. The purpose of the hub 50 is to reduce the amount of fluid required within the totality of the basin 42 in order to maintain proper flow within the fountain. The hub 50 also serves as the resting point for the bottom of the barrel 18.

Figure 5:
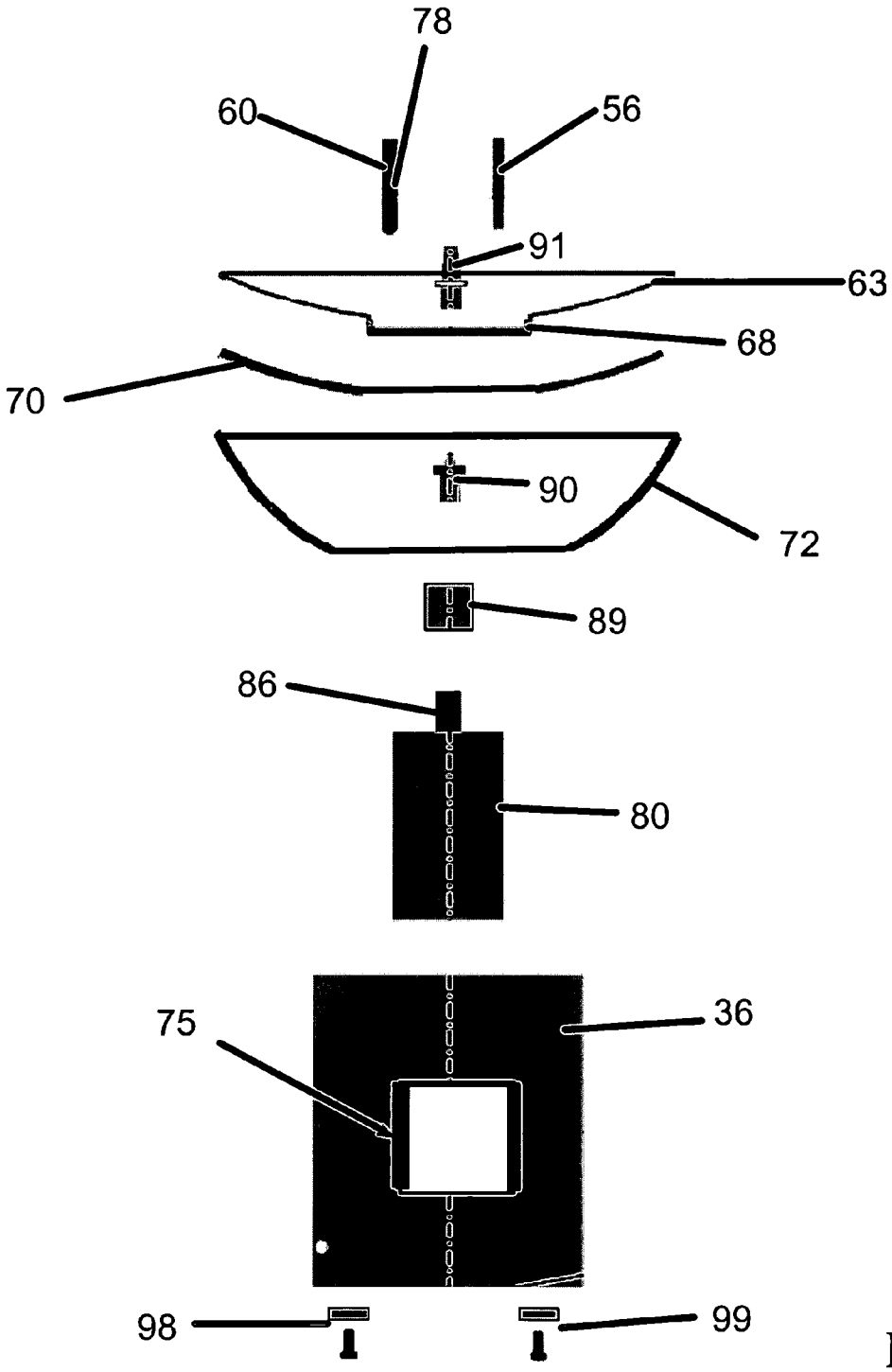
FIG. 5 is an exploded partial cross-sectional side view of a bottom module of the fountain of the present invention.

The lower most barrel section 20 has a plurality of raised support locks 52, 53, 54 (not shown) welded around the periphery on the bottom of the exterior of barrel section 20. Barrel section 20 is secured to the base 36 of the edible medium fountain using a plurality of vertical support pins 56, 60, 61 (not shown) extending from base 36. As shown in FIG. 5, the support pins 56, 60, 61 (not shown) extend from the interior of the base 36 through a heating surface 63 and the lower basin 42, and into a set number of holes in the barrel support locks 52, 53, 54 (not shown). In a preferred embodiment, only three support locks are used to engage with three support pins. The base of the support locks 52, 53, 54 (not shown) rests on the hub 50 of the lower basin 42.

Figure 6:
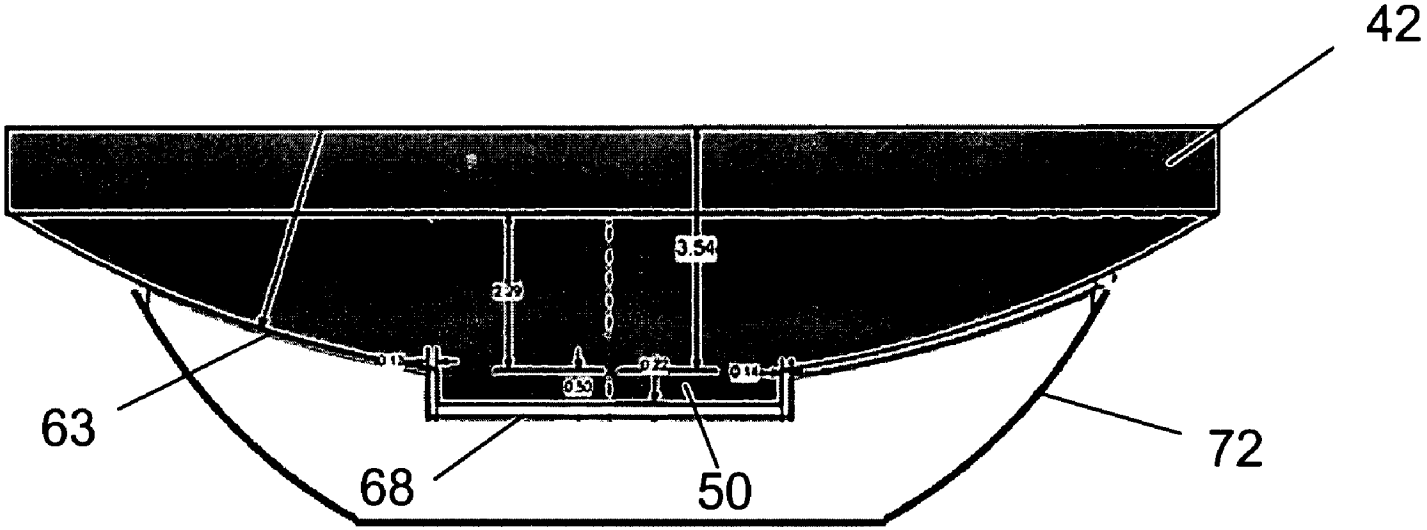
FIG. 6 is a side view of the bottom pan and heating pan of a fountain of the present invention.
Figure 7:
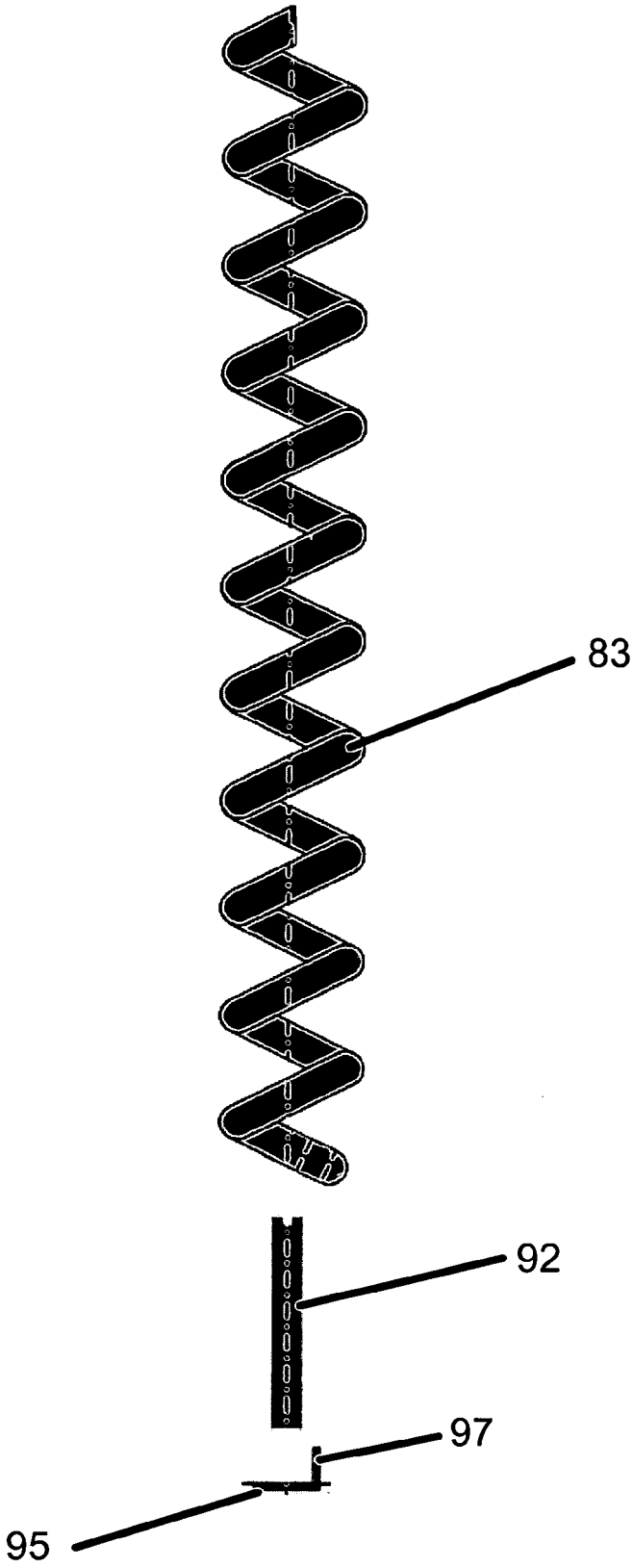
FIG. 7 is a side view of a removable Archimedes screw support and the drive ring of a fountain of the present invention.

The lower basin 42 rests on a heating surface 63 that is contoured to fit at least an internal portion of the lower basin 42. A heating surface hub 68 is formed in the heating surface 63. The heating surface hub 68 is sized and configured to enable hub 50 of the lower basin to fit therein. A gasket (not shown) is placed over the support pins 56, 60 substantially covering the exposed surface of the heating surface hub 68. The lower basin 42 slips over the vertical support pins 56, 60 onto the gasket. The gasket then serves to seal the space between the vertical support pins 56, 60 and 61 (not shown) and the hub 50 to prevent fluid from flowing between the vertical support pins 56, 60, 61 (not shown) and the hub 50. The basin and gasket are able to be removed for cleaning. The lower basin 42 slips over the vertical support pins 56, 60, 61 (not shown) and is able to be removed for cleaning. A heater 70 is shaped substantially the same as the lower basin 42 including a lower hub section such that the lower basin 42 fits substantially with the exposed section of the heating surface 63. In a preferred embodiment, a silicon wire wound heater heats the heating surface 63. A module heating surface support 72 supports the lower basin 42, heating surface 63, and heater 70. FIG. 6 illustrates the lower basin 42 as supported by the heating surface 63 and heating support surface 72.

A controller 75 within the base 36 accomplishes control of the heater 70. The temperature of the fluidic material within the edible medium fountain 10 is measured at a point by a thermistor 78 within the hub 50. The thermistor 78 is encapsulated within one of the vertical pins 60 that supports the barrel 18. The temperature of the fluid is limited by maximum set by a commercial thermostat in the controller 75 attached to the thermistor 78 within the encapsulated pin 60.

The lower module 13 is substantially sealed and contains the controller 75, which provides both control for the heater 70 but also a variable speed motor 80 to control the speed of a removable Archimedes screw 83. The speed of motor 80 and temperature of the fluidic material is adjusted for appropriate flow of the fluid within the basins 39, 42, barrel 18, and tiers 26, 27, 28, 29. Motor 80 is enclosed in the base 36 and its drive element 86 is connected to the Archimedes screw 83 by a coupling 89 and a series of shaft sections 90, 91, 92. The lower shaft section 90 is attached to the coupling 89. Extending from the center of the hub 50 is a middle shaft section 91 that is attached to the drive ring 95 and the upper shaft section 92 to support the removable Archimedes screw 83 during the instance of the edible medium fountain 10. The fountain uses a removable Archimedes screw 83 specifically designed for this device with no welded or permanent attachments. The removable Archimedes screw 83 is fitted over the upper shaft section 92 and drive ring 95. The drive ring 95 is locked in place in any one instance of the edible medium fountain onto the shaft sections by the upper shaft section 92. The drive ring 95 is attached to the removable Archimedes screw 83 at a single point with a pin 97 that extends from the drive ring 95. The hub 50 is fitted with an FDA approved Teflon inner ring/seal (not shown) that fits over the middle shaft 91 and provides a seal between the center of the hub 50 and the top surface of the hub heating surface 68. The drive ring 95 fits over the middle shaft section 91 after the lower basin 42 is placed over the vertical support pins 56, 60, 61 (not shown) and the drive ring rests on the Teflon inner ring seal (not shown). After the drive ring 95 is placed over the middle shaft section 91, the upper shaft section 92 is screwed onto the middle shaft section 91 thereby locking the drive ring 95 in place. The drive ring 95 is of such a width that it extends over the center opening within the hub 50 and secures the lower basin 42 in place during operation of the edible medium fountain 10. The drive ring 95 fits over the opening in the center of the hub 50 such that it overlaps the entire opening in the center of the hub 50. This effectively locks the lower basin 42 to the lower module 13 when the drive ring 95 is locked in place.

The base 36 is provided with leveling wheels 98, 99 within the lower module 13 to allow for adjustment and leveling of the edible medium fountain 10.

The invention has been described with references to a preferred embodiment. While specific values, relationships, materials and steps have been set forth for purposes of describing concepts of the invention, it will be appreciated by persons skilled in the art that numerous variations and/or modifications may be made to the invention as shown in the specific embodiments without departing from the spirit or scope of the basic concepts and operating principles of the invention as broadly described. It should be recognized that, in the light of the above teachings, those skilled in the art can modify those specifics without departing from the invention taught herein. Having now fully set forth the preferred embodiments and certain modifications of the concept underlying the present invention, various other embodiments as well as certain variations and modifications of the embodiments herein shown and described will obviously occur to those skilled in the art upon becoming familiar with such underlying concept. It is intended to include all such modifications, alternatives and other embodiments insofar as they come within the scope of the appended claims or equivalents thereof. It should be understood, therefore, that the invention may be practiced otherwise than as specifically set forth herein. Consequently, the present embodiments are to be considered in all respects as illustrative and not restrictive.

What is claimed is:

1. A fountain for recirculating warmed fluid, comprising:

a lower module, comprising:

a variable speed motor having a drive shaft and a drive ring fitted over said drive shaft, said drive ring being fitted with a vertical component, and a heating sub-module having a heated surface and a heating element having controls to control the temperature of said fluid; and an upper containment module, comprising:

a lower basin, a variable number of interlocking tubes forming a barrel, an upper basin that fits over the uppermost interlocking tube, and a variable number of tiers that are secured in place by said interlocking tubes, wherein the number of tiers is equal to the number of interlocking tubes; and an Archimedes screw of length determined by the number of interlocking tubes, wherein the vertical component of said drive ring fits into a hole within the Archimedes screw and said Archimedes screw is operationally attached to the drive shaft of said variable speed motor, wherein said lower module includes at least one vertical stud within a center hub to guide and restrain the upper containment module, said center hub further comprising a section in its center extending downward from the lower basin through which the shaft and said vertical studs pass, and wherein said heating sub-module further comprises a hub to fit concentrically with the lower basin;

said at least one vertical stud further comprising a temperature probe extending into the lower basin.

2. The fountain of claim 1, further comprising a digital controller to control the temperature of said fluid and the speed of said variable speed motor.

3. The fountain of claim 1, wherein the upper containment module tubes comprise a bottom tube with machined male end and middle tubes with one male end and one female end.

4. The fountain of claim 3, wherein the upper module tubes have been machined to provide a male and female ends such that the tubes may interlock on the male end machined circumference.

5. The fountain of claim 4, wherein the machining of the tubes provides declination of material thickness exists on the male, machined ends and an inclination of gauge on the female, machined end.

6. The fountain of claim 5, wherein the width of the inclination and the declination are such that the material from the female ends fits within the male declination.

7. The fountain of claim 1, wherein the upper module tiers have an inner circumference that allows them to fit over the modular male end of the machined tubes.

8. The fountain of claim 7, wherein the tiers placed on the male end of the tubes are secured in right angle position to the tube set when the female end is placed over a male end.

9. The fountain of claim 1, wherein the upper basin is of solid metal.

10. The fountain of claim 9, wherein the solid metal upper basin is has an inner circumference that is equal to the inner circumference of the tiers.

11. The fountain of claim 9, wherein the upper basin will fit over the circumference of the male end of the modular tubes.

12. The fountain of claim 9, wherein the upper basin will fit over the circumference of the male end of the modular tube functions as the female end of modular tubes.

13. The fountain of claim 1, wherein the flights within the Archimedes screw are of a diameter to fit within the inner circumference of the upper module tubes.

14. The fountain of claim 1, wherein the Archimedes screw is supported vertically by a vertical post.

15. The fountain of claim 14, wherein the post supporting the Archimedes screw is itself attached to the vertical shaft extending from the lower module.

16. The fountain of claim 14, wherein the attachment of the supporting post act to hold the drive ring firmly in place.

17. The fountain of claim 16, wherein the drive ring being held in place itself holds the lower basin in close proximity to an upper section of the lower control module.

18. The fountain of claim 17, wherein the drive ring bottom has a seal placed between it and the lower basin to prevent leakage of fluid from the top module to the bottom module.

19. The fountain of claim 18, wherein the lower basin has a hub distended from the lower middle section that fits concentrically within the depressed hub on the lower module heated surface serving to minimize fluid required for recirculation.

20. The fountain of claim 18, wherein the lower basin has a hub distended from the lower middle section containing holes for the shaft and vertical supports for the tubes.

21. The fountain of claim 1, wherein the lower module heating surface is composed of a copper curved surface that is contoured to fit within close proximity to the bottom surface of the lower basin.

22. The fountain of claim 1, wherein the lower module may be leveled using three wheels attached to each of the three feet on the lower module.

23. The fountain of claim 1, wherein the lower module attached to the upper module parts by vertical appendages from the lower module through the lower module lower basin; supporting substantially modular tubes and tiers perpendicular to the bottom module; provides rotational mechanical force through a shaft from the lower module attaching and supporting an Archimedes screw wherein the Archimedes screw when rotating supports fluidic material within the tube upwardly from the bottom basin to the top basin and overflowing the top basin onto the tiers and back into the lower basin.

* * * * *